United States Patent [19]

O'Konski

[11] 4,011,704

[45] Mar. 15, 1977

[54] NON-GHOSTING BUILDING CONSTRUCTION

[75] Inventor: Theodore S. O'Konski, Wheeling, W. Va.

[73] Assignee: Wheeling-Pittsburgh Steel Corporation, Pittsburgh, Pa.

[22] Filed: Nov. 1, 1972

[21] Appl. No.: 302,830

Related U.S. Application Data

[63] Continuation-in-part of Ser. No. 175,967, Aug. 30, 1971, abandoned.

[52] U.S. Cl. ..... 52/735; 72/324

[51] Int. Cl.[2] ..... E04C 3/09; E04C 3/32

[58] Field of Search ..... 52/670–675, 52/730–732, 344, 357, 367, 243, 311, 361–363, 735, 633–635, 356, 376, 481, 573, 242, 466, 468; 29/163.5, 6.1, 6.2; 72/185, 186, 324

[56] References Cited

UNITED STATES PATENTS

| | | | |
|---|---|---|---|
| 675,402 | 6/1901 | Orr | 52/348 |
| 808,789 | 1/1906 | Voss | 52/356 |
| 1,597,318 | 8/1926 | Kane | 52/364 |
| 1,820,700 | 8/1931 | Hatch | 52/468 |
| 1,837,630 | 12/1931 | Pawling | 52/243 |
| 1,964,403 | 6/1934 | Loucks | 52/481 |
| 2,048,981 | 7/1936 | Vass | 52/355 |
| 2,052,024 | 8/1936 | Hahn | 52/670 |
| 2,410,922 | 11/1946 | Balduf | 52/481 |
| 3,108,406 | 10/1963 | Ellis | 52/670 |
| 3,135,320 | 6/1964 | Forgo | 165/181 |
| 3,802,147 | 4/1974 | O'Konski | 52/454 |

FOREIGN PATENTS OR APPLICATIONS

| | | | |
|---|---|---|---|
| 23,074 | 12/1895 | United Kingdom | 52/672 |
| 7,952 | 4/1909 | United Kingdom | 52/673 |

*Primary Examiner*—James L. Ridgill, Jr.
*Attorney, Agent, or Firm*—Buell, Blenko & Ziesenheim

[57] ABSTRACT

The specification discloses metallic structural channel members for building construction which are characterized by low thermal conductivity and low sound transmission. The channel members have two end panels connected by a side panel. The side panel has a plurality of rows of strips, severed from the side panel along two coextensive parallel slits and stretched out of the plane of the panel. The rows of strips are displaced variously all to one side or all to the other, or part to one side and part to the other of the side panel. The end panels are also provided with severed strips, somewhat wider than the strips on the side panel, for mounting wall board or metal lath elements.

5 Claims, 8 Drawing Figures

INVENTOR
Theodore S. O'Konski
By Buell, Blenko & Ziesenheim
his Attorneys

NON-GHOSTING BUILDING CONSTRUCTION

This application is a continuation-in-part of my prior application Ser. No. 175,967, filed Aug. 30, 1971, now abandoned.

This invention relates to building construction elements characterized by low thermal conductivity which will inhibit and avoid ghosting on the walls of buildings. The invention has special usefulness in forming metallic studding and tracks for use in construction of buildings.

A common method of building construction is to erect a skeleton consisting of spaced-apart vertical studs and horizontal members or tracks tying them together at selected places. Ordinarily the skeleton is of timber, commonly 2 by 4 inch boards. After electrical, plumbing, and heating services are provided, further material is erected on each side of the studding. Thus each wall is commonly a composite structure. The facing material on each side of the studding is often referred to as a "wall".

This application is directed to construction of composite structures, and the material on each side of the studding is referred to as a wall. The composite structures thus comprise the studding and a wall on each side of the studding. The invention is especially directed to instances where the composite structure stands between the enclosed space and the outdoors and it is so described herein. It is to be understood, however, that the invention may also be used in instances where the composite structure stands between two enclosed spaces.

In the ordinary composite structure, exposed to the weather, the exterior wall may include sheathing, building paper, brick, masonry, stucco, or the like. The interior wall may be of plaster board, lath and plaster, or the like. Insulating material is often placed in the space between the inner and outer walls. The general method of construction is well known and numerous variations of construction are possible. Although the method is traditionally followed with on-site construction, it is also employed, with variants, for fabrication prior to erection.

It has been proposed to use metal members in place of timber for studding and the like in building construction. Metal members have the advantages of high strength, good dimensional stability, and may be formed from a common article of commerce. Metal studs and the like may readily be joined by welding either at a factory or a field site. They are especially adapted to a prefabricated construction.

It is known that in cold weather heat is withdrawn through the walls of a building to the outside. If the walls are not well insulated, heat may be withdrawn so rapidly so to chill the inner walls below the dew point and to cause moisture to condense upon them from the air within the building. Dirt which is present in the air tends to deposit especially upon the wet areas and to form dark streaks. The pattern of the studding is often reflected in dirt deposition and is known as "ghosting". A drawback of metal studding and like members is that they have a high coefficient of thermal conduction, and are thereby especially susceptible to ghosting upon an inside wall since heat will be rapidly conducted from the inside wall through a metal member to the outside. In hot moist climates where the interior space is air conditioned, ghosting may occur on the outside of the building structure.

I provide metal members, such as studding, intermediate the inner and outer walls of the building. I form the members generally in a channel shape having an end panel abutting the inside wall, an end panel abutting the outside wall, and a side panel extending between the end panels. I cut portions from the side panel by severing the panel in two coextensive parallel slits, thereby interrupting continuity of the side panel between the end panels. I further arrange the severed areas in staggered and overlapping relationship so that a tortuous or labyrinthian path through the metal is formed between the end panels. I preferably displace the severed area from the plane of the panel leaving the areas connected, however, at their ends to the panel. The severed areas thereby provide strength to the structural member which would be not provided if they were cut completely from the panel and removed. The severed areas are in the form of rectangular strands each displaced from and parallel to the normal plane of the metal, and joined thereto at each end of the strand.

The severed areas may be formed in a variety of patterns. I prefer to form them in a row and to arrange a plurality of parallel rows. The severed areas in adjacent rows are formed in offset, overlapping relationship. In a present form of the invention in which the metal channel member has the dimensions of common lumber, 1½ by 3½ inches, I provide four rows of severed areas displaced to one side of the side panel of the metallic member. The severed areas are ⅜ of an inch in width and the rows are separated by a distance of approximately 7/16 of an inch. The metallic member is preferably formed of ordinary galvanized carbon steel.

In a present preferred embodiment of the invention, also of the dimensions of common lumber, 1½ by 3½ inches, I provide four rows of severed areas of strips displaced in one direction out of the plane of the side panel, and three individually intervening rows of severed areas or strips in staggered relation to the severed areas or strips in the four rows and displaced in the opposite direction out of the plane of the side panel. At the same time I provide similarly formed severed areas or strips in the end panels of the metal member. These severed strips provide additional air space between the end panels of the metal member and the constituent wall elements, such as metal lath or wall broad. These severed strips on the end panels also provide a means of attachment of the wall elements to the metal member, as by screws engaging holes punched or formed in the severed strips.

I also provide another embodiment of the invention in connection with so-called track elements, that is the top and bottom members horizontally connecting the vertically disposed studs to form a partition or wall frame. Such track elements are metal channel members that fit over the top and bottom ends of the studding elements and have a side panel with two end panels at opposite ends respectively of the side panel. In this embodiment, however, the parallel-extending rows of severed strips in the side panel are all displaced toward the interior of the channel members, thereby providing a flat face on the outside of the side panel for supporting a partition or wall frame at top and bottom.

Other details, objects and advantages of the invention will become more apparent as the following description of a present preferred embodiment thereof proceeds.

Several embodiments of the invention are shown in the accompanying drawings in which.

Figure 1:
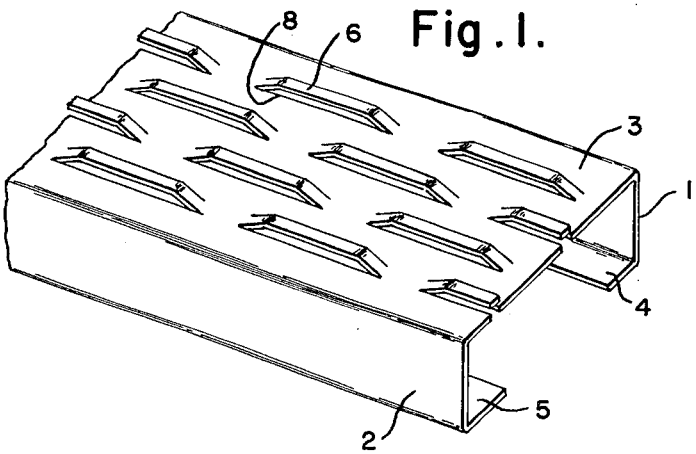
FIG. 1 is an isometric view of a stud for building construction formed from galvanized carbon steel and having portions cut out from the panel forming the long side of the stud which embodies the invention.
Figure 5:
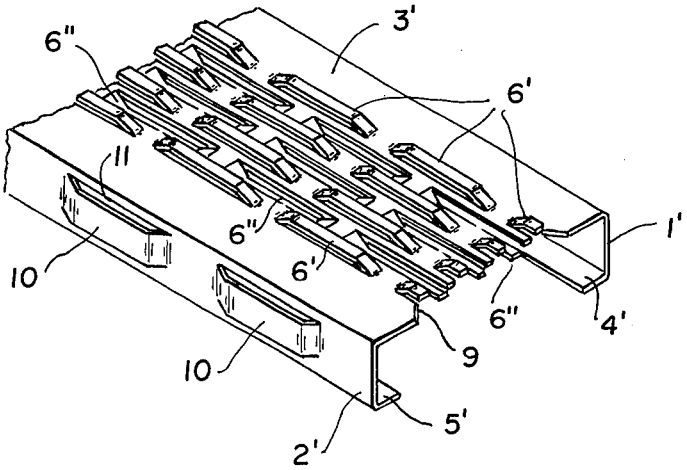
Figure 6:
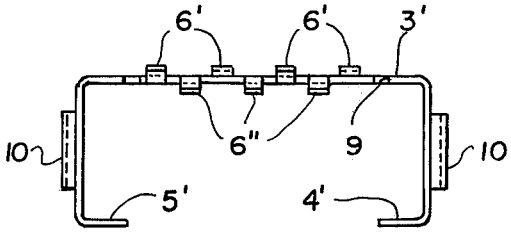
Figure 7:
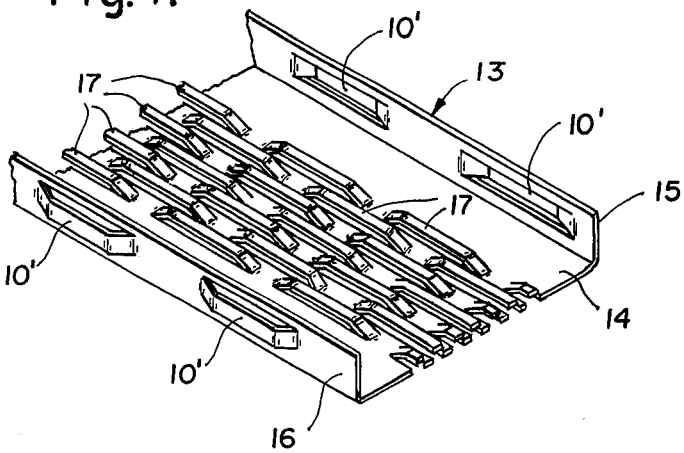
Figure 8:
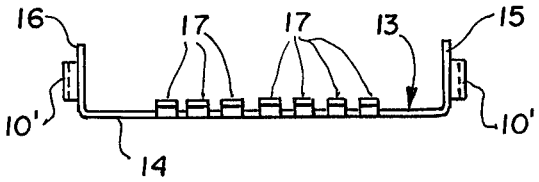

FIG. 5 is an isometric view of a present preferred embodiment of the invention in the form of a metal stud member, similar to that of FIG. 1, in which the severed strips in the side panel are arranged in parallel rows with adjacent rows of severed strips extending in opposite directions of the plane of the side panel and in which the end panels are also provided with longitudinally spaced severed strips for attachment of wall elements to the studs in spaced relation thereto;

FIG. 6 is an end view of the form of stud shown in FIG. 5;

FIG. 7 is an isometric view showing another embodiment of the invention as applied to a metal channel member constituting a track element, in which the severed strips are all displaced out of the plane of the side panel in one direction toward the interior of the channel member;

FIG. 8 is an end view of the form of track element shown in FIG. 7.

The stud is preferably formed by rolling from flat steel stock. The stock may conveniently be galvanized for corrosion resistance and the like. The details of forming flat stock into the general configuration shown in the drawings are well known and need not be started here. The stud comprises end panels 1 and 2 and a side panel 3 which extends between end panels 1 and 2. Flanges 4 and 5 are formed on the edges of end panels 1 and 2 opposite from side panel 3. Flanges 4 and 5 are made short enough to permit cutting of panel 3 through the gap between the ends of flanges 4 and 5.

Side panel 3 has sections cut out from it. The sections are relatively narrow strips aligned in rows and parallel rows are formed.

One section or strip cut from plane 3 is identified by reference number 6. The metal is cut at 7 and at 8 in coextensive parallel slits and the cut out portion 6 is deformed or stretched outwardly by cold working from the plane of panel 3 without breaking. No cut is made between slits 7 and 8 and so that the cut out metal is simply deformed from the panel of panel 3. Metal strip 6 thereby continues to provide structural strength to the stud. I prefer a trapezoidal contour for the deformed portion, that is, a contour having a central flat area parallel to the panel 3 and end areas that slope toward the plane of panel 3. Such contour provides substantial rigidity for the deformed portion 6 and adds physical strength to the panel itself.

Figure 2:
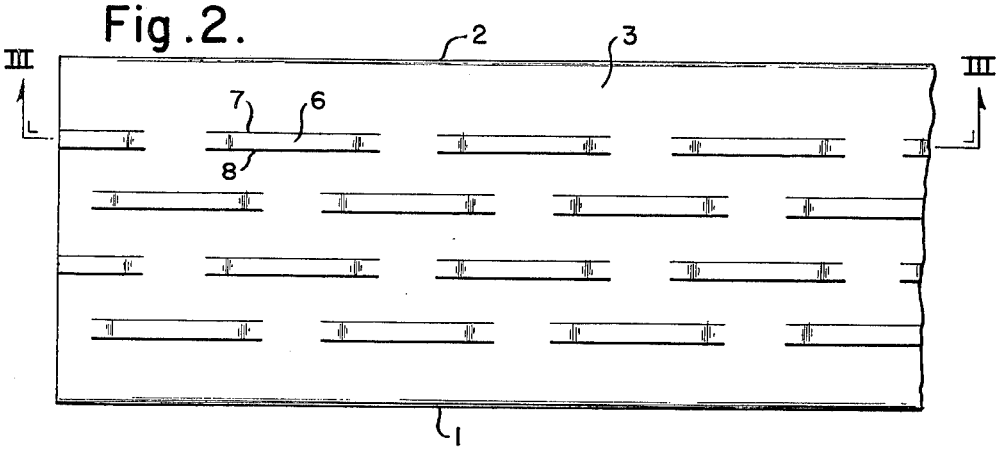
FIG. 2 is a plan view of the stud shown in FIG. 1 and showing the side panel of the structural member of FIG. 1.
Figure 3:
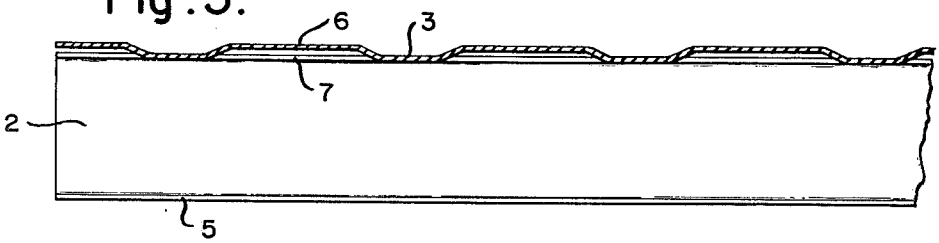
FIG. 3 is a sectional view taken along line III—III of FIG. 2.
Figure 4:
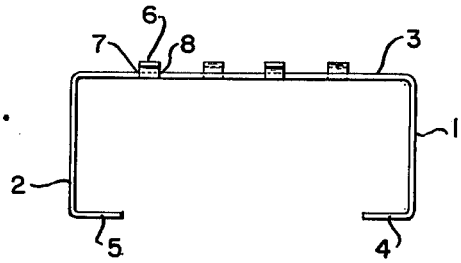
FIG. 4 is an end view of the stud shown in FIG. 2.

As can be seen best from FIGS. 1 and 2 a plurality of cut out portions are formed like cut out portion 6. They are formed at intervals in rows. A series of parallel rows are formed, and the cut out portions in adjacent rows are disposed in overlapping, offset relationship. A particularly advantageous arrangement is to provide four rows in which the cuts in each row are approximately 3/16 inch apart and the distance between adjoining rows is approximately 7/16 inch. Each cut is in the order of 1¾ inches long with an uncut space of approximately ⅝inches between it and the next cut in the same row.

If a source of heat is applied to the end panel of a metal stud like that shown in FIG. 1, but without cut out portions, the opposite end panel will quickly become too hot to touch. When a like source of heat is applied to the stud of FIG. 1 having cut out portions, a different result is obtained. If the heat is applied to end panel 1, end panel 2 remains comfortably cool to the touch even though end panel 1 is quite hot along its length some distance from the source of heat. It is thought that the provision of the cuts produces a tortuous elongated path by which heat must travel from one end panel to the other. Accordingly, the effect is to introduce an insulating effect into side panel 3. Since the heat transmission through the stud is drastically reduced, ghosting will be eliminated or substantially reduced. It is also believed that the cut out portions will serve as small radiators of heat from the stud to the space between the inner and out walls. They will thereby produce moving air currents between the wall in the space between the walls and will cause a generally even temperature to exist along the wall between the studs. The even temperature will thereby overcome ghosting which results from an uneven temperature.

A present preferred embodiment of the invention is shown in FIG. 5. In this embodiment the stud comprises end panels 1′ and 2′ and a connecting side panel 3′ with flanges 4′ and 5′ formed on the end panels parallel to the side panel 3. As distinguished from the embodiment of FIG. 1, this embodiment not only has four parallel spaced rows of narrow strips 6′ severed from and extending outwardly with respect to the side panel 3′, but it also has three additional rows of narrow strips 6″, individually intervening between the rows of strips 6′ and extending inwardly to the stud in a direction opposite to that of the strips 6′. FIG. 6 clearly shows the disposition of strips 6′ and 6″ on opposite sides of the plane of side panel 3′.

The opposite ends of the side panel 3′ of the stud in the form shown in FIG. 5 are provided with recesses 9 to accomodate the fitting of end tracks thereon as hereinafter more fully explained.

In addition, the end panels are provided with straps 10 formed similarly to the strips 6′ annd 6″ by severing the end panels in two coextensive parallel slits 11 and displacing the intervening area outwardly with respect to the plane of the end panel 1′ and 2′. Straps 10 are relatively wider than the strips 6° and 6″. Holes (not shown) may be punched or drilled into the straps 10 into which screws may extend for securing wall elements, such as metal lath or wall board, to the stud. The straps 10 are trapezoidal in contour for inherent rigidity and also for retention of maximum physical strength in the stud. The displacement of the flat portion of the straps 10 is such as to support wall elements in spaced relation to the metal stud, thereby minimizing the are of contact with the stud by the wall elements, such as metal lath or wall board, with consequent minimization of thermal transmission or conduction through the stud in the wall frame.

If desired, other types of means integrally formed on the stud for attachment of wall elements may be employed in lieu of or in addition to the straps 10, such as those disclosed in my copending application Ser. No. 168,957, filed Aug. 4, 1971.

As explained in relation to the embodiment of FIG. 1, the provision of the severed strips 6′ and 6″ in the side panel 3′ of the stud of FIG. 5 produces a tortuous or labyrinthian path from which heat may radiate, thereby to reduce thermal conductivity from one end panel 1′ or 2′, to the other. By reason of the disposition of the strips 6′ and 6″ on opposite sides of the plane of the side panel 3′, the degree of thermal conductivity from end panel to end panel is much lower in the embodiment of FIG. 5 than in the embodiment of FIG. 1. The use of straps 10 on the side panels 1′ and 2′ also further assists in the reduction of thermal conductivity through the stud from wall surface to wall surface. Tests have demonstrated the superiority of the embodiment of metal stud in FIG. 5 over wood studding in respect to low thermal conductivity.

The extent to which strips 6, 6′ and 6″ are displaced from the normal plane of the metal is carefully controlled to avoid stressing the metal beyond the yield point. There is, however, work hardening which takes place at the ends of strips 6, 6′ and 6″. The result is to increase the strength in those localized areas. Tests made of the structure shown in FIGS. 5 and 6 indicate that it has adequate strength in both bending and compression probably exceeding the strength of a conventional metal steel.

It has also been found that the provision of strips 6′ and 6″ on metal stud, as depicted in FIG. 5, also produces a marked reduction in conduction of sound through a wall employing the stud. That is thought to be accounted for by the fact that the strips 6′ and 6″ break up the sound waves traveling from wall surface to wall surface. The avoidance of a flat panel by the presence of the strips and the varying hardness of the stud from localized work hardening apparently avoids resonance.

Referring to FIGS. 7 and 8, an embodiment of the invention is there shown comprising a metal track or channel 13 having a side panel 14 and two end panels 15 and 16 projecting at right angles to the side panel 14 at opposite ends thereof. The side panel 14 of channel 13 is somewhat wider than the side panel 3′ of the stud in FIG. 5 in order to allow the end panels 15 and 16 to straddle the end panels 1′ and 2′. Thus the track member 13 is employed to connect, support and join vertically disposed studs such as shown in FIGS. 1 and 5, at both top and bottom ends of a wall.

The side panel 15 of track 13 is provided with a plurality of parallel rows, shown as seven in number although the number could vary, of strips 17 similar to strips 6′ and 6″. It will be noted that all of the rows of strips 17 are in the inside of the side panel 14. In this case it is expedient to have the rows of strips 17 displaced in the same direction, that is, to the inside of the side panel 14 in order to allow the outer surface of the side panel 14 to provide a flat supporting face for the wall. The same is true when the track member 13 is employed to connect the top ends of the studs in a wall.

With the strips 17 projecting inwardly it is necessary to provide the recess 9 in the top and bottom ends of stud as shown in FIG. 5, into which recess the strips 17 may fit or extend, without interference with the top and bottom ends of the stud.

The end panels 15 and 16 may also be provided with straps 10′ similar to straps 10 of FIG. 5, to provide a means of attachment for wall surface elements along the top of a wall. If desired, attaching means similar to those disclosed in my copending application, Ser. No. 168,957, filed Aug. 4, 1971 may be substituted for or employed along with the strips 10′.

Changes may be made in details without sacrificing all advantages of the invention. The width and spacing of the cut sections may be changed, recognizing, however that structural strength or head insulating and sound conduction properties may be adversely affected. Accordingly, it is to be understood that the invention may be otherwise variously practiced within the scope of the following claims.

I claim:

1. A metal structural channel member formed of a single thickness of sheet metal and having a side panel and two end panels at opposite ends of the side panel, said side panel having a plurality of closely spaced parallel rows of areas each severed therefrom along two coextensive parallel slits and stretched laterally from the plane of the side panel to a plane parallel to the original plane of the side panel, said areas being characterized by an absence of slits between the parallel slits, the areas in adjacent rows being straggered with respect to each other and displaced to opposite sides of the original plane of the side panel to provide a multiplicity of different tortuous paths through the side panel of the channel member for lengthening the thermal conduction path from end panel to end panel to inhibit heat conduction therethrough from end panel to end panel and for enhancing heat radiation therefrom.

2. A metal structural channel member comprising a single thickness of sheet metal and having a side panel and two end panels at opposite ends of the side panel, said side panel having a plurality of closely spaced parallel rows of areas each severed therefrom along two coextensive parallel slits and stretched laterally from the plane of the side panel on one side thereof to a plane parallel to the original plane of the side panel, said areas being characterized by an absence of slits between the parallel slits, the areas in adjacent rows being staggered with respect to each other to provide a multiplicity of tortuous paths through the side panel of the channel member for lengthening conduction path from one end panel to the other to inhibit heat conduction from end panel to end panel and for enhancing heat radiation.

3. A metal structural channel member according to claim 2, wherein said plurality of severed areas are all disposed laterally to the outside of said side panel.

4. A metal structural channel member according to claim 2, wherein said plurality of severed areas are all disposed laterally to the inside of said side panel.

5. A metal structural channel member according to claim 2, wherein said plurality of rows of severed areas are arranged in a first group disposed laterally to one side of said side panel and in a second group of at least one row interposed between two adjacent rows of said first group and disposed laterally to the opposite side of said side panel.

* * * * *

UNITED STATES PATENT OFFICE

CERTIFICATE OF CORRECTION

PATENT NO. : 4,011,704

DATED : March 15, 1977

INVENTOR(S) : THEODORE S. O'KONSKI

It is certified that error appears in the above-identified patent and that said Letters Patent are hereby corrected as shown below:

Column 1, line 24, "wall" should be in quotations.

Column 1, line 55, "so" should read --as--.

Column 2, line 13, "area" should read --areas--.

Column 2, line 45, "broad" should read --board--.

Column 3, line 34, "started" should read --stated--.

Column 3, line 51, "panel" should read --plane--.

Column 4, line 45, "annd" should read --and--.

Column 4, line 49, "6" should read --6'--.

Column 4, line 57, "are" should read --area--.

Column 5, line 61, after "of" should read --a--.

Column 6, line 7, "strips" should read --straps--.

Column 6, line 11, "head" should read --heat--.

UNITED STATES PATENT OFFICE
CERTIFICATE OF CORRECTION

Patent No. 4,011,704 Dated March 15, 1977

Inventor(s) THEODORE S. O'KONSKI

It is certified that error appears in the above-identified patent and that said Letters Patent are hereby corrected as shown below:

Column 6 Claim 2, line 47, after "lengthening" should read -- the thermal --.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*